US012247411B2

(12) United States Patent
Lemon

(10) Patent No.: US 12,247,411 B2
(45) Date of Patent: Mar. 11, 2025

(54) PICKET FENCE BOARD PROTECTORS

(71) Applicant: Matthew Wayne Lemon, The Woodlands, TX (US)

(72) Inventor: Matthew Wayne Lemon, The Woodlands, TX (US)

(73) Assignee: Matthew Wayne Lemon, The Woodlands, TX (US)

( * ) Notice: Subject to any disclaimer, the term of this patent is extended or adjusted under 35 U.S.C. 154(b) by 0 days.

(21) Appl. No.: 17/886,133

(22) Filed: Aug. 11, 2022

(65) Prior Publication Data

US 2023/0184002 A1 Jun. 15, 2023

Related U.S. Application Data

(60) Provisional application No. 63/289,280, filed on Dec. 14, 2021.

(51) Int. Cl.
*E04H 17/14* (2006.01)

(52) U.S. Cl.
CPC ..... *E04H 17/1426* (2013.01)

(58) Field of Classification Search
CPC . E04H 12/2292; E04H 17/006; E04H 17/055; E04H 17/06; E04H 17/063; E04H 17/1426; E04H 17/143; E04H 17/1439
USPC ..... 256/1, 19, 22, 34
See application file for complete search history.

(56) References Cited

U.S. PATENT DOCUMENTS 4,478,391 A 10/1984 Kovach
4,593,872 A * 6/1986 Svensson ..... E04H 12/2223 52/157
4,907,783 A 3/1990 Fisk
4,989,834 A * 2/1991 Hudgins ..... E04H 17/14 256/1
5,039,065 A 8/1991 Denton
5,328,156 A 7/1994 Hoke
5,503,371 A * 4/1996 Bies ..... E04H 12/2292 256/1
5,622,356 A * 4/1997 Duggan ..... E04H 12/2292 256/19
6,073,416 A * 6/2000 Peter ..... E04H 12/2292 52/298

(Continued)

FOREIGN PATENT DOCUMENTS

GB 2123872 A * 2/1984 ..... E04H 12/2292
WO WO2012171464 A1 12/2012

OTHER PUBLICATIONS

"Fillet Vs Chamber: A Complete Guide for Applications." Wayken Rapid Manufacturing. Nov. 20, 2021, [online], [retrieved on Oct. 17, 2023] Retrieved from the Internet <URL: https://web.archive.org/web/20211101090424/https://waykenrm.com/blogs/fillet-vs-chamfer-a-complete-guide-for-applications>.*

*Primary Examiner* — Josh Skroupa

(57) ABSTRACT

A fence protector comprising a box, a plurality of gripping slats, and a plurality of drainage holes. The box further comprising a front face, a back face, a left-side face, a right-side face, a bottom face, an interior side, an exterior side, and a top opening, wherein the top opening is positioned opposite the bottom face and configured to accept picket boards. The plurality of gripping slats is connected to the interior side of the box and configured to grip and hold the picket board to the fence protector. The plurality of drainage holes is positioned in the bottom face of the box and configured to allow water to drain from the fence protector.

5 Claims, 14 Drawing Sheets

(56) References Cited

U.S. PATENT DOCUMENTS

| | | | | |
|---|---|---|---|---|
| 7,004,458 | B1 * | 2/2006 | Grubba | E04H 17/063 256/19 |
| 7,104,525 | B2 * | 9/2006 | Ricci | E04H 12/2292 256/19 |
| 7,878,487 | B2 * | 2/2011 | Pearson | E04H 17/066 256/22 |
| 8,366,078 | B2 * | 2/2013 | Meglino | E04H 17/066 256/22 |
| 10,100,551 | B2 * | 10/2018 | Pacheco | E04H 17/006 |
| 10,697,199 | B2 * | 6/2020 | Hellenbrand | E04H 17/1439 |
| 2001/0000548 | A1 * | 5/2001 | Niehaus | E04H 12/2292 29/450 |
| 2007/0245645 | A1 * | 10/2007 | Nesbitt | E04H 12/2292 52/745.19 |
| 2010/0277290 | A1 * | 11/2010 | Knudsen | E04H 12/2269 264/32 |

* cited by examiner

PICKET FENCE BOARD PROTECTORS

FIELD OF THE INVENTION

The present invention relates generally to a picket fence protector 1 or fence protector 1. More specifically, the picket fence board protector provides a sleeve-like structure that prevents scratches or damages to the bottom portion of the fence board.

BACKGROUND OF THE INVENTION

Picket fence is a type of fence used for enclosing an area for decorative purposes or privacy. The picket fence is commonly made of vertical wooden pickets that are side by side, spaced or non-spaced. Picket fences are commonly used in outdoor neighborhoods as non-spaced privacy fences. Since the picket fences are installed outdoors, they can be damaged from multiple sources. Especially, the bottom portions of a vertical picket fence board can easily be damaged from weed-eating machines, rot, and other causes.

An objective of the present invention is to provide a sleeve-like fence board protector that can securely fit onto the bottom of a picket fence board. The fence protector 1 prevents damage from yard equipment such as weed-eaters or other causes. Also, the fence protector 1 may prevent insects from getting into the picket fence board. The size of the present invention can vary depending on the size requirements of the picket fence boards. Additional features and benefits are further discussed in the sections below.

SUMMARY OF THE INVENTION

The present invention is a fence protector comprising a box, a plurality of gripping slats, and a plurality of drainage holes. The box of the fence protector comprises a front face, a back face, a left-side face, a right-side face, a bottom face, an interior side, an exterior side, and a top opening, creating a rectangular box shape with one open face. The top opening is positioned opposite the bottom face and configured to accept a picket board. The plurality of gripping slats is connected to the interior side of the box and configured to grip the picket board, keeping the fence protector from sliding off the picket board. The plurality of drainage holes is positioned through the bottom face of the box and configured to allow water to drain from the fence protector.

DETAILED DESCRIPTION OF THE INVENTION

All illustrations of the drawings are for the purpose of describing selected versions of the present invention and are not intended to limit the scope of the present invention.

Figure 1:
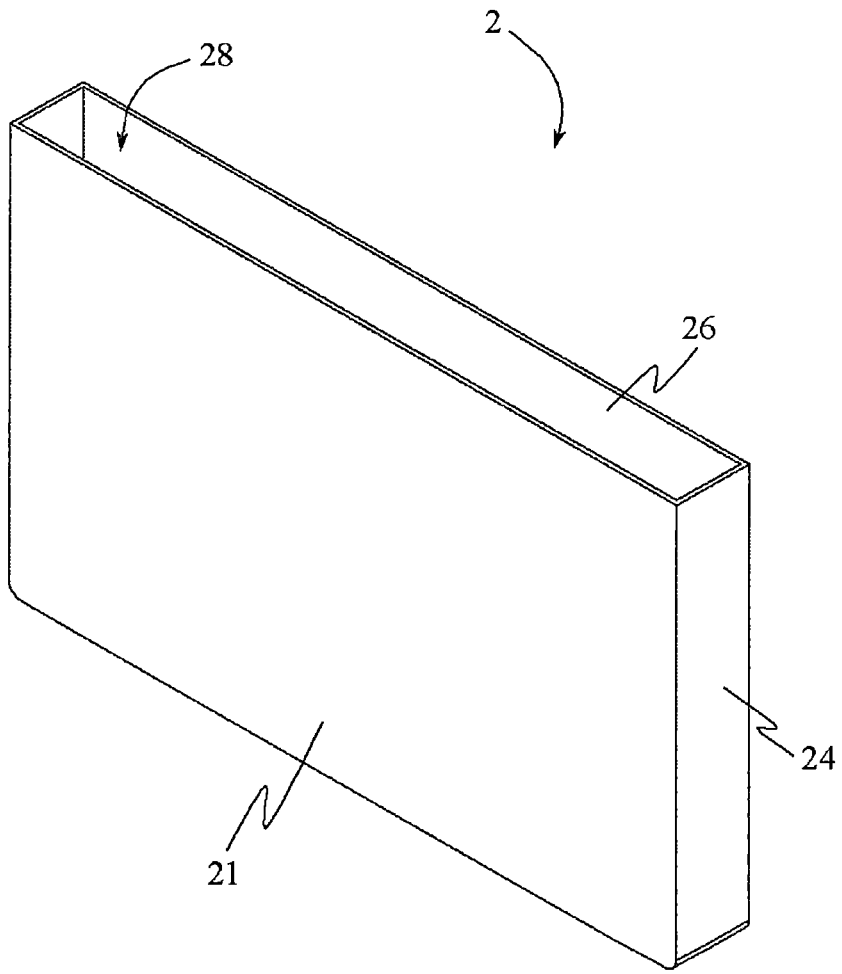
FIG. 1 is a top front isometric view of the fence protector of the present invention, in accordance with at least one embodiment.
Figure 2:
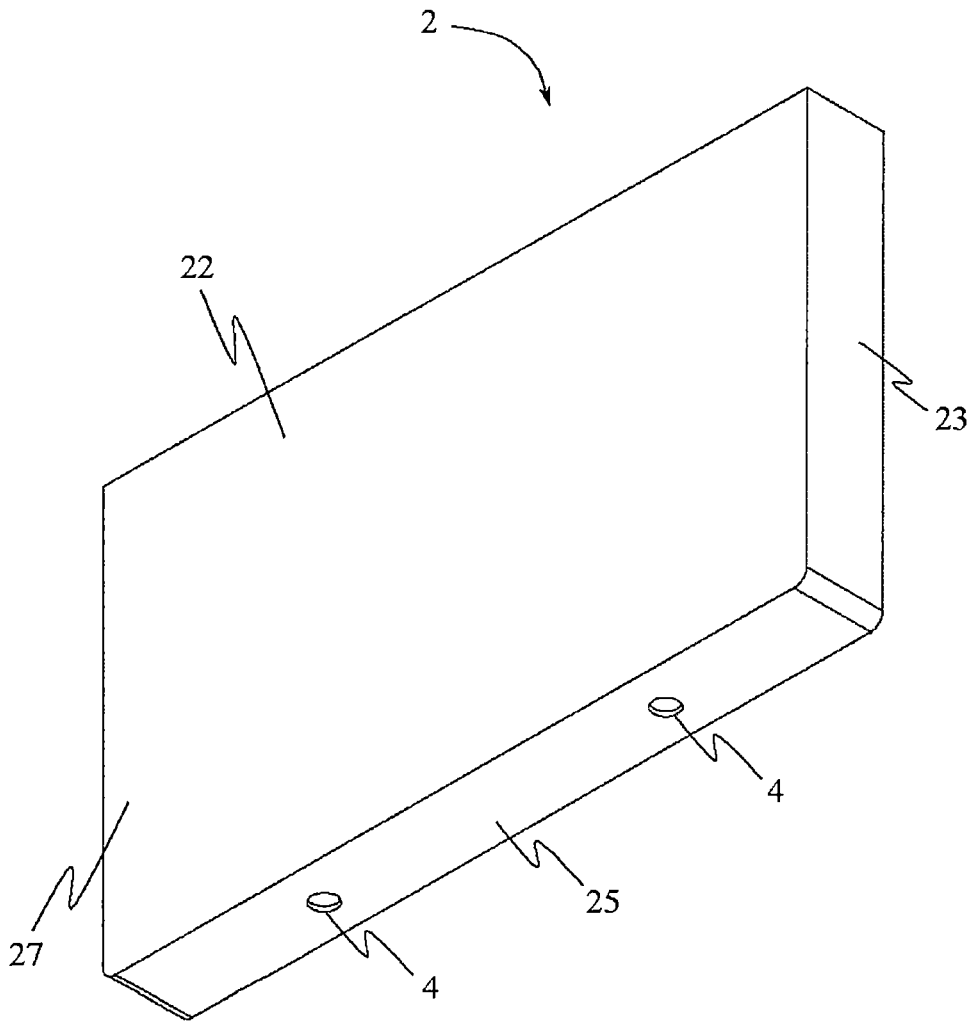
FIG. 2 is a bottom rear isometric view of the fence protector of the present invention, in accordance with at least one embodiment.
Figure 3:
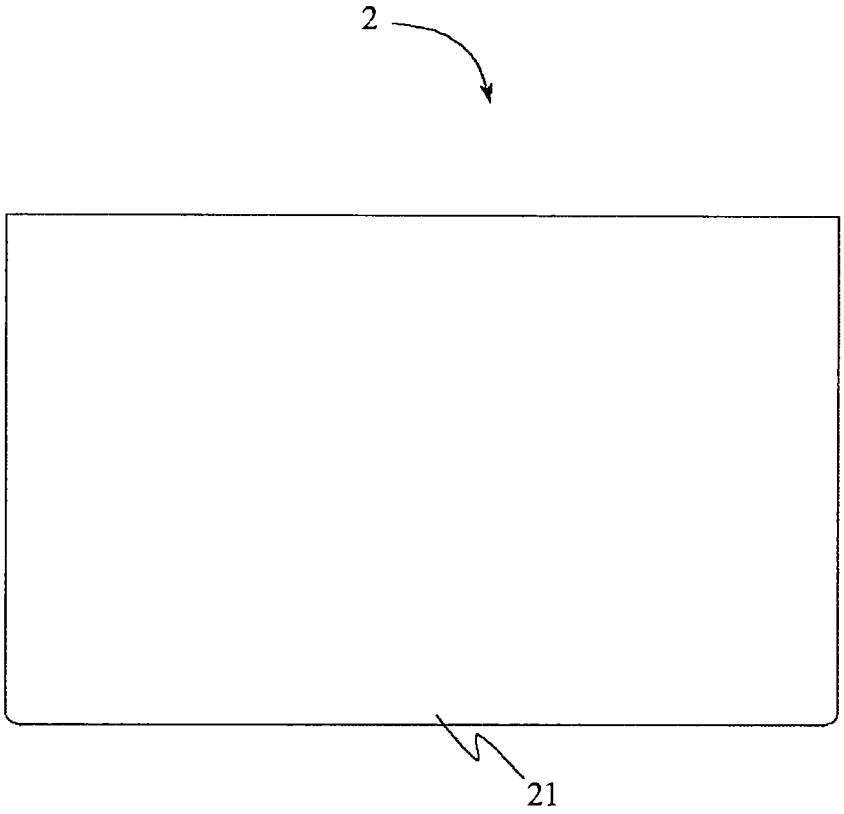
FIG. 3 is a front elevation view of the fence protector of the present invention, in accordance with at least one embodiment.
Figure 4:
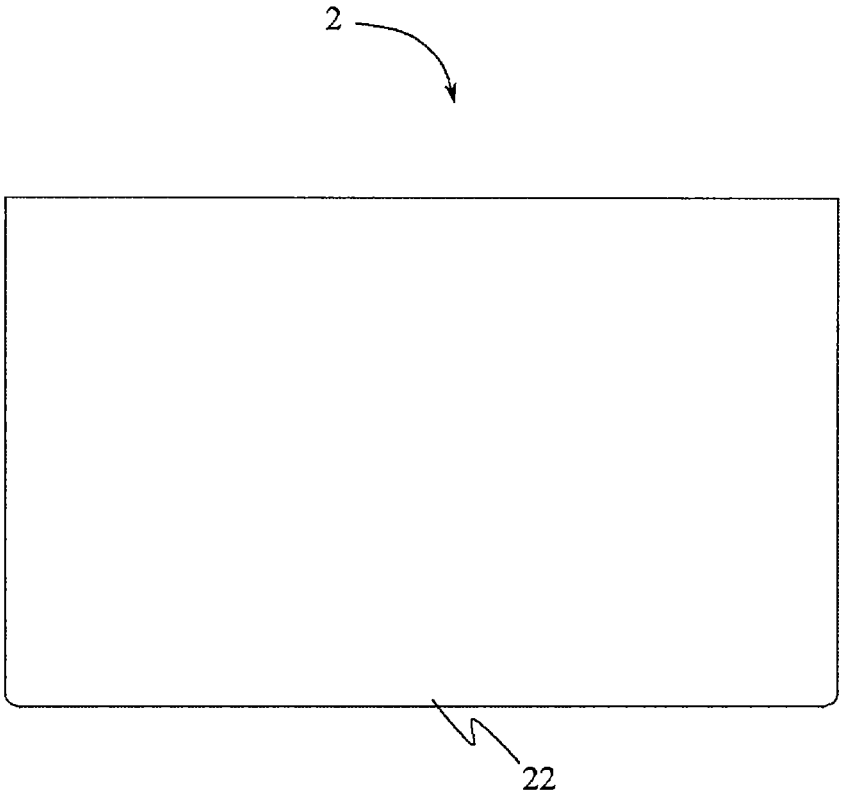
FIG. 4 is a rear elevation view of the fence protector of the present invention, in accordance with at least one embodiment.
Figure 5:
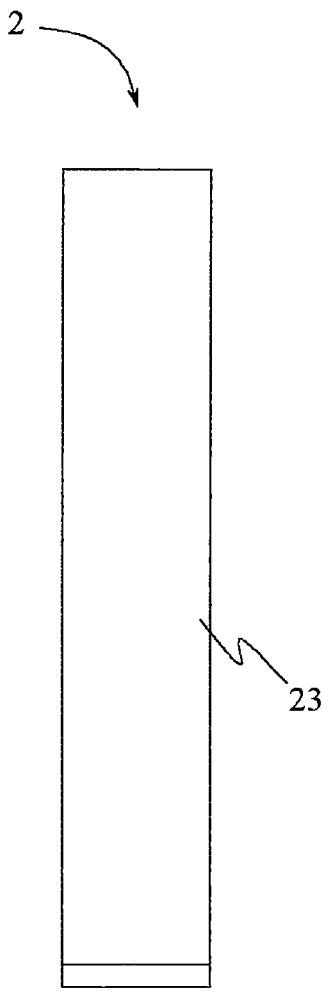
FIG. 5 is a right-side elevation view of the fence protector of the present invention, in accordance with at least one embodiment.
Figure 6:
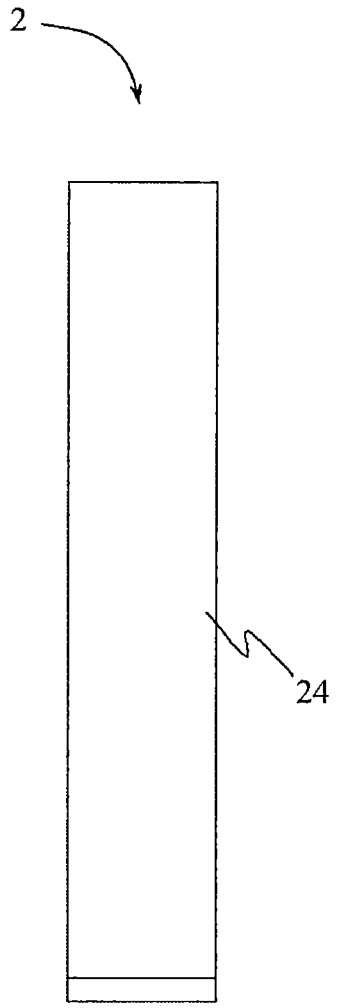
FIG. 6 is a left-side elevation view of the fence protector of the present invention, in accordance with at least one embodiment.

As can be seen in FIGS. 1-2, the present invention provides a sleeve-like picket fence board protector that can securely fit onto the bottom of the picket fence. The picket fences are installed outdoors for enclosing an area for privacy or decorative purposes and are exposed to damages from yard equipment and other causes. Utilizing the present invention, the user can prevent the damages and other wear and tear. Additionally, the present invention may prevent insects from getting into the picket fence.

The fence protector 1 of the present invention comprises a box 2 having a front face 21, a back face 22, a left-side face 23, a right-side face 24, a bottom face 25, and a top opening 28. The front face 21 is positioned opposite the back face 22, the right-side face 24 is positioned opposite the left-side face 23, and the bottom face 25 is positioned opposite the top opening 28. The box 2 also comprises an interior side 26 and an exterior side 27.

Figure 7:
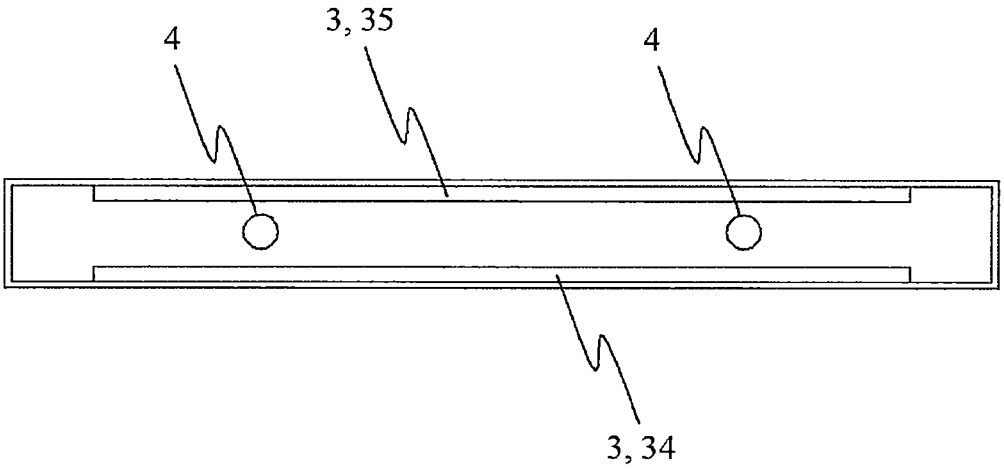
FIG. 7 is a top plan view of the fence protector of the present invention, in accordance with at least one embodiment.
Figure 9:
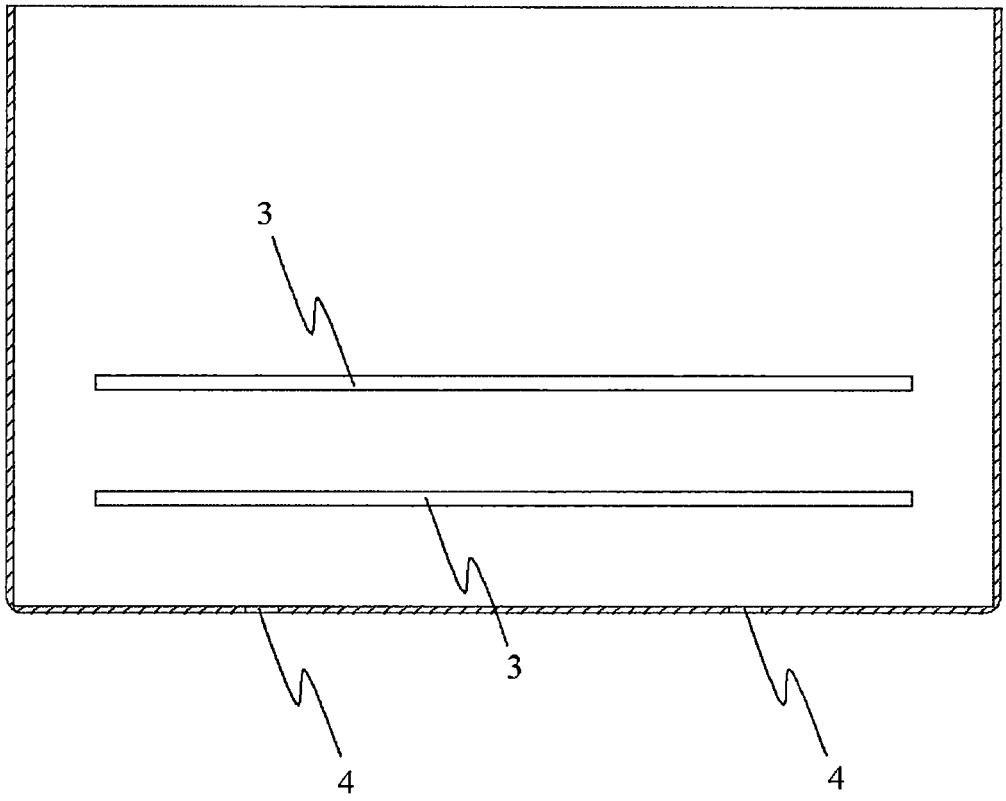
FIG. 9 is a cross-sectional view of the fence protector of FIG. 3, in accordance with at least one embodiment.
Figure 10:
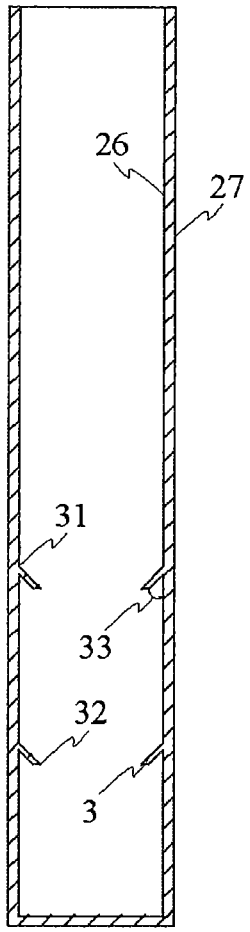
FIG. 10 is a cross-sectional view of the fence protector of FIG. 5, in accordance with at least one embodiment.

In addition to the shape and structure of the box 2, the fence protector 1 of the present invention further comprises a plurality of gripping slats 3 and a plurality of drainage holes 4. The plurality of gripping slats 3 is intended to keep the present invention from sliding off a picket board 5 when attached to the picket board 5. As seen in FIGS. 7, 9, and 10, the plurality of gripping slats 3 is positioned on the interior side 26 of the box 2. The plurality of gripping slats 3 is preferably positioned on the front face 21 and the rear face of the box 2, though the plurality of gripping slats 3 may also or alternatively be positioned on the left-side face 23 and the right-side face 24. In the preferred embodiment of the present invention, the plurality of gripping slats 3 comprises a first set of gripping slats 34 and a second set of gripping slats 35 with the first set of gripping slats 34 positioned on the front face 21 of the box 2 and the second set of gripping slats 35 positioned on the back face 22 of the box 2. Preferably, the position of the second set of gripping slats 35 on the back face 22 mirrors the position of the first set of gripping slats 34 on the front face 21, though in alternative embodiments, the first set of gripping slats 34 and the second set of gripping slats 35 may be offset from one another vertically and/or horizontally. Each of the first set of gripping slats 34 and the second set of gripping slats 35 may comprise any number of gripping slats, with the preferred number of gripping slats being two for each set of gripping slats.

Each gripping slat of the plurality of gripping slats 3 comprises an attachment side 31 and a gripping side 32. The attachment side 31 connects to the interior side 26 of the box 2. The gripping side 32 is opposite the attachment side 31 and is configured to grip the picket board 5 in order to prevent the fence protector 1 from slipping off the picket board 5. Referring to FIG. 10, a slat angle 33 between each of the plurality of gripping slats 3 and the base are angled downward of around 45 degrees although this angle may vary, ideally gripping the picket as its' described functional intent. In one embodiment, the gripping side 32 has a sharp edge configured to cut into the picket board 5 and hold the fence protector 1 in place. Alternative embodiments may have a rounded gripping side 32 to prevent damage to the picket board 5. In other alternative embodiments, the plurality of slats 3 may have a flat gripping side 32. In some embodiments, the plurality of slats 3 may be made of a non-slip material, or the gripping side 32 may be coated in a non-slip coating to further prevent the fence protector 1 from sliding off the picket board 5 and hold the fence protector 1 in place without departing from the conceptual scope of the invention while referencing the adjoining claims.

Figure 8:
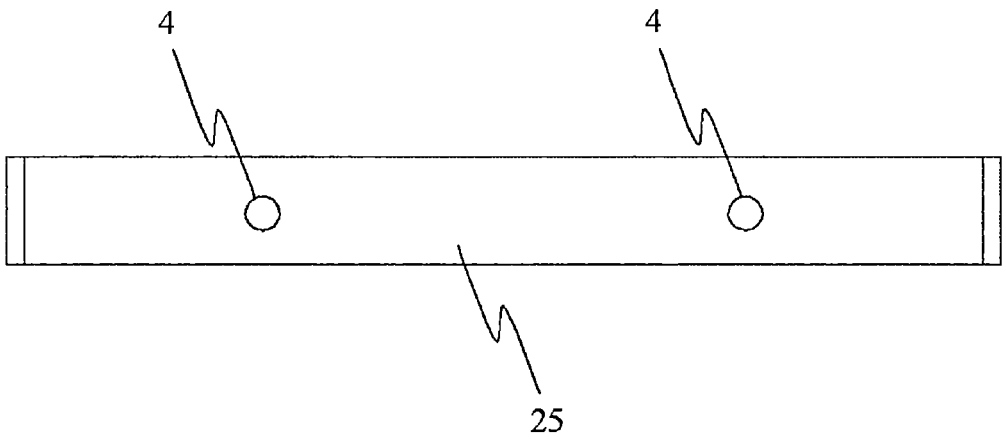
FIG. 8 is a bottom plan view of the fence protector of the present invention, in accordance with at least one embodiment.

The plurality of drainage holes 4 is intended to allow water or other materials that enter the fence protector 1 to escape the fence protector 1. As can be seen in FIGS. 2, 7, and 8, the plurality of drainage holes 4 traverses the bottom face 25 of the box 2, creating an opening from the interior of the box 2 to the exterior of the box 2. The plurality of drainage holes 4 are most effective on the bottom face 25 of the box 2 but may also be employed on the other faces of the box 2. In the preferred embodiment, the plurality of drainage holes 4 comprises drainage holes spaced apart along the bottom face 25 of the box 2. In one alternative embodiment, the plurality of drainage holes 4 may be small holes, collectively making up a mesh-like structure. Any number of drainage holes may be used.

Dimensions of the fence protector 1 may vary depending on the size requirements of the picket board 5. As can be seen in FIGS. 1-4, the fence picket provides a rectangular structure having curved edges between the bottom face 25 and the left-side face 23 and right-side face 24 of the box 2. In alternative embodiments, the picket board 5 may provide a rectangular structure having angled edges between the bottom face 25 and the left-side face 23 as well as between the bottom face 25 and the right-side face 24. The fence protector 1 of the present invention may come in alternative shapes depending on the shape of the picket board 5 of the relevant fence. For example, a semi-circular shape may be used to match a picket board 5 with a semi-circular bottom or a triangular shape may be used to match a picket board 5 with a triangular bottom. However, even in cases where the bottom of the picket board 5 is not rectangular, the rectangular-shaped fence protector 1 may still be used. In the preferred embodiment, the fence protector 1 is made of a plastic material. However, metal, wood, ceramic, or other materials may be used for the fence protector 1 of the present invention.

Figure 11:
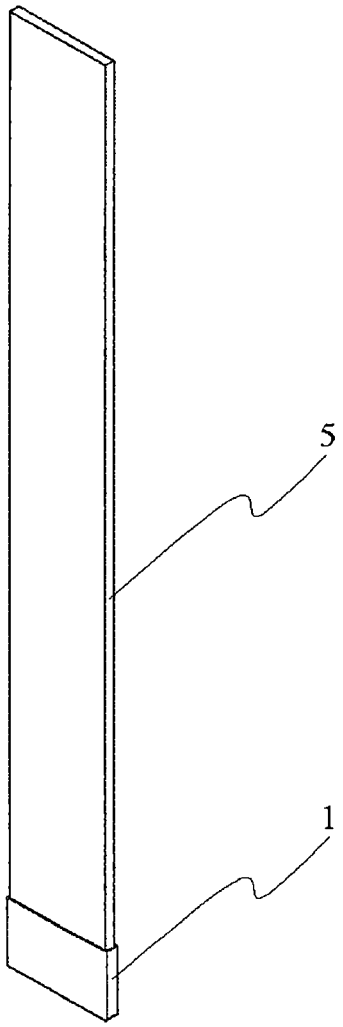
FIG. 11 is a top front perspective view of the assembly of a fence board and the fence protector of the present invention.
Figure 12:
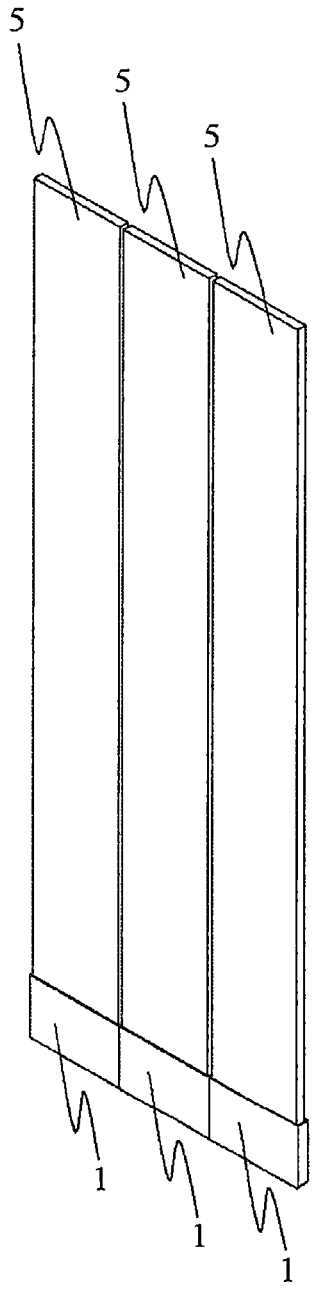
FIG. 12 is a top front perspective view of multiple assemblies of fence boards and the fence protectors of the present invention.

As can be seen in FIGS. 11-12, the assemblies of the picket fence and the fence protectors 1 can be installed side by side. Further, the fence protectors 1 may be joined to one another as a single panel of multiple fence protectors 1 to be fitted onto multiple picket boards 5 simultaneously as is sometimes common to have fence panels built into 8' sections. Additionally, the fence protector 1 can be of various colors or designs based on the user's requirement.

Figure 13:
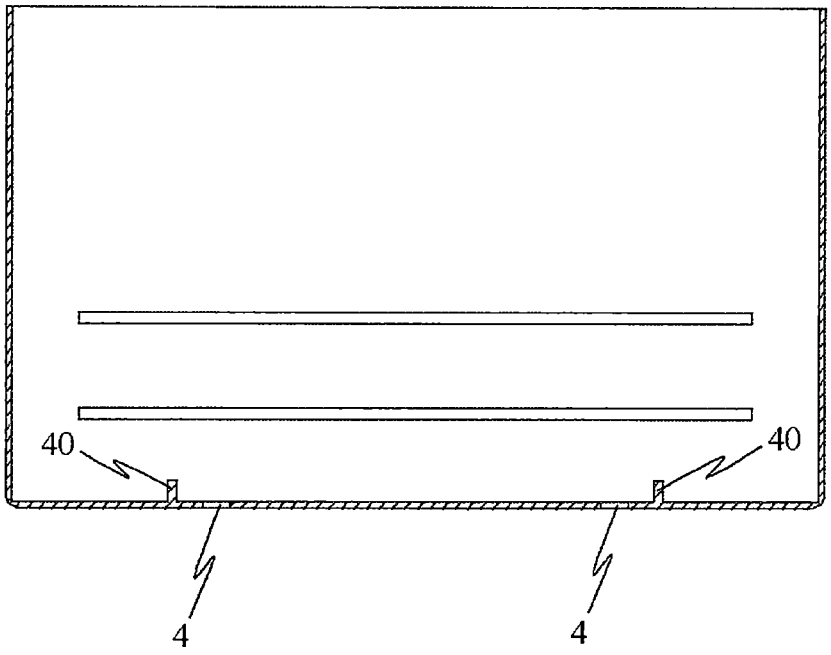
FIG. 13 is a cross-sectional view of the fence protector in accordance with at least one embodiment.
Figure 14:
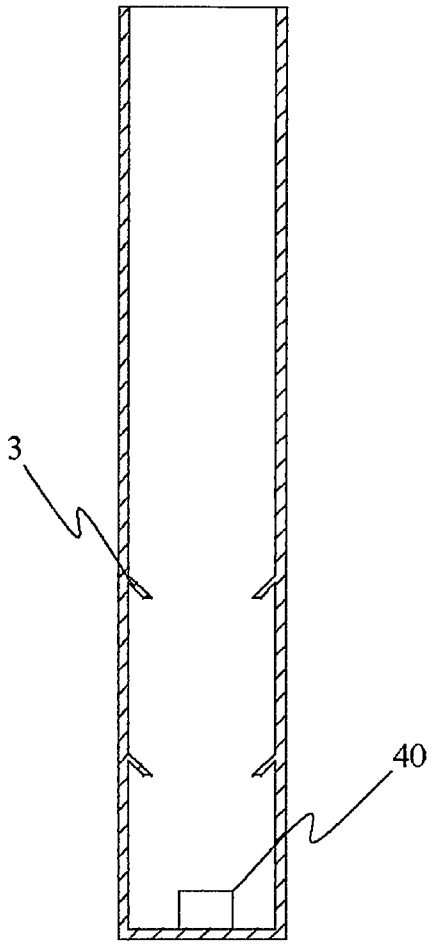
FIG. 14 is a cross-sectional view of the fence protector in accordance with at least one embodiment.

As can be seen in FIGS. 13-14, in one embodiment of the present invention, the fence protector 1 may further comprise at least one spacer 40. The at least one spacer 40 is configured to separate a picket board 5 from the bottom face 25 of the box 2 when the picket board 5 is engaged with the box 2. By separating the picket board 5 and the bottom face 25 of the box 2, water can more easily drain out of the plurality of drainage holes 4. The at least one spacer 40 is positioned on the interior side 26 of the bottom face 25, though in alternative embodiments, the at least one spacer could be on any other face of the box 2.

Although the invention has been explained in relation to its preferred embodiment, it is to be understood that many other possible modifications and variations can be made without departing from the conceptual scope of the invention with references made for the adjoining claims.

What is claimed:

1. A fence protector, comprising:

a box;

a plurality of gripping slats;

the box further comprising a front face, a back face, a left-side face, a right-side face, a flat bottom face, an interior side, an exterior side, and a top opening;

each of the plurality of gripping slats further comprising an attachment side and a gripping side;

the gripping side being positioned opposite the attachment side;

the attachment side connecting to the interior side of the box;

the gripping side being connected to the attachment side by two parallel sides; and the gripping side configured to cut into a fence picket board at a downward angle toward the bottom face to hold the protector in place.

2. The fence protector of claim 1, further comprising:

the front face positioned opposite the back face;

the left-side face positioned opposite the right-side face;

the front face being connected to the left-side face and connected to the right-side face; and the back face being connected to the left-side face and connected to the right-side face the bottom face being connected to the left-side face, connected to the right-side face, connected to the front face, and connected to the back face.

3. The fence protector of claim 1, further comprising:

the plurality of gripping slats further comprises of multiple sets of gripping slats;

one of the gripping slats of a set connected to the interior side of the box on the front face; and another gripping slat of the same set connected to the interior side of the box on the back face; and the position of the one gripping slat of a set of gripping slats on the back face is positioned across from another gripping slat of the same set on the front face.

4. The fence protector of claim 1, further comprising:

a plurality of drainage holes;

the plurality of drainage holes traversing through the bottom face of the box;

at least one spacer; and the at least one spacer positioned on the interior side of the bottom face and configured to be positioned below the fence picket board to allow drainage from the bottom face through the drainage holes.

5. A fence protector, comprising:

a box;

a plurality of gripping slats;

a plurality of drainage holes;

at least one spacer;

the box further comprising a front face, a back face, a left-side face, a right-side face, a flat bottom face, an interior side, an exterior side, and a top opening;

the front face positioned opposite the back face;

the left-side face positioned opposite the right-side face;

the top opening positioned opposite the bottom face;

the plurality of drainage holes traversing through the bottom face of the box;

the at least one spacer positioned on the interior side of the bottom face to allow drainage;

each of the plurality of gripping slats further comprising an attachment side and a gripping side;

the gripping side being positioned opposite the attachment side;

the attachment side connecting to the interior side of the thin-box;

the gripping side being connected to the attachment side by two parallel sides;

the gripping side configured at a downward angle toward the bottom face to cut into a fence picket board to hold the protector in place;

the plurality of gripping slats further comprising multiple sets of gripping slats;

one gripping slat of a set connected to the interior side of the box on the front face;

the other gripping slat of the same set connected to the interior side of the box on the back face;

wherein the position of the one gripping slat of a set of gripping slats on the back face is positioned across from another gripping slat of the same set on the front face.

* * * * *